US006374754B1

(12) United States Patent
Chang

(10) Patent No.: US 6,374,754 B1
(45) Date of Patent: Apr. 23, 2002

(54) MULTI-LAYER DESK

(76) Inventor: Chien-Kuo Chang, Fl. 10-2, No. 447, Sec. 3, Wen-Hsin Rd., Taichung (TW)

( * ) Notice: Subject to any disclaimer, the term of this patent is extended or adjusted under 35 U.S.C. 154(b) by 0 days.

(21) Appl. No.: 09/760,658

(22) Filed: Jan. 17, 2001

(51) Int. Cl.[7] ..... A47B 37/00
(52) U.S. Cl. ..... 108/92; 108/102; 108/50.02; 108/184
(58) Field of Search ..... 312/154, 223.3; 108/50.02, 92, 101, 102, 184, 187, 189; 211/186; 248/165, 917, 918, 440.1, 424

(56) References Cited

U.S. PATENT DOCUMENTS 4,646,655 A * 3/1987 Robolin ..... 108/101 X
5,623,881 A * 4/1997 Huang ..... 108/102 X
6,220,180 B1 * 4/2001 Janowitz ..... 108/189 X

* cited by examiner

*Primary Examiner*—Janet M. Wilkens
(74) *Attorney, Agent, or Firm*—Rosenberg, Klein & Lee

(57) ABSTRACT

A desk includes two first legs and two first support members extending from the two first legs so as to support a first top on the two first support members. Two second support members respectively extend from the two first legs and are located below the two first support members. Two first rods are retractably received in the two second support members and each of the first rods is connected to a connection frame so that a second top is supported on the two connection frames. Two second legs with wheels are respectively connected to the first rods. Two sleeves are respectively connected to the two connection frames and two second rods are retractably received in the two sleeves. A third top is supported on the two second rods.

4 Claims, 4 Drawing Sheets

MULTI-LAYER DESK

FIELD OF THE INVENTION

The present invention relates to a desk that has two more layers retractably connected to the desk top and each of the two layers has a top board.

BACKGROUND OF THE INVENTION

A conventional office desk generally includes a desk top and four legs connected to the top and some drawers are connected to an underside of the top. The desk top usually has a fixed size and cannot expand so that the user has to make a good arrangement for his/her stationery to be put on the desk top. Generally, a personal computer is put on the top desk and occupies a large space on the desk top so that the user has to use the rest of space of the desk top to put the documents and/or other stationery. The conventional desk obviously cannot meet requirements of the users today.

SUMMARY OF THE INVENTION

In accordance with one aspect of the present invention, there is provided a desk and comprising two first legs connected by a first transverse bar and two first support members respectively extend from the two first legs. A first top is supported on the two first support members. Two second support members respectively extend from the two first legs and are located below the two first support members. Each of the second support members has a slot defined therethrough. Two first rods are retractably received in the two second support members and each of the first rods is connected to a connection frame. One of two ends of each of the connection frames extends through the slot of the second support members. A second top is supported on the two connection frames. A second transverse bar is connected between the two first rods and two second legs are respectively connected to the second transverse bar. Each of the two second legs has a wheel connected thereto. Two sleeves are respectively connected to the two connection frames and two second rods are retractably received in the two sleeves. A third top is supported on the two second rods.

The primary object of the present invention is to provide a desk that has two more layers retractably connected to an underside of the desk top so as to have more space to use.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
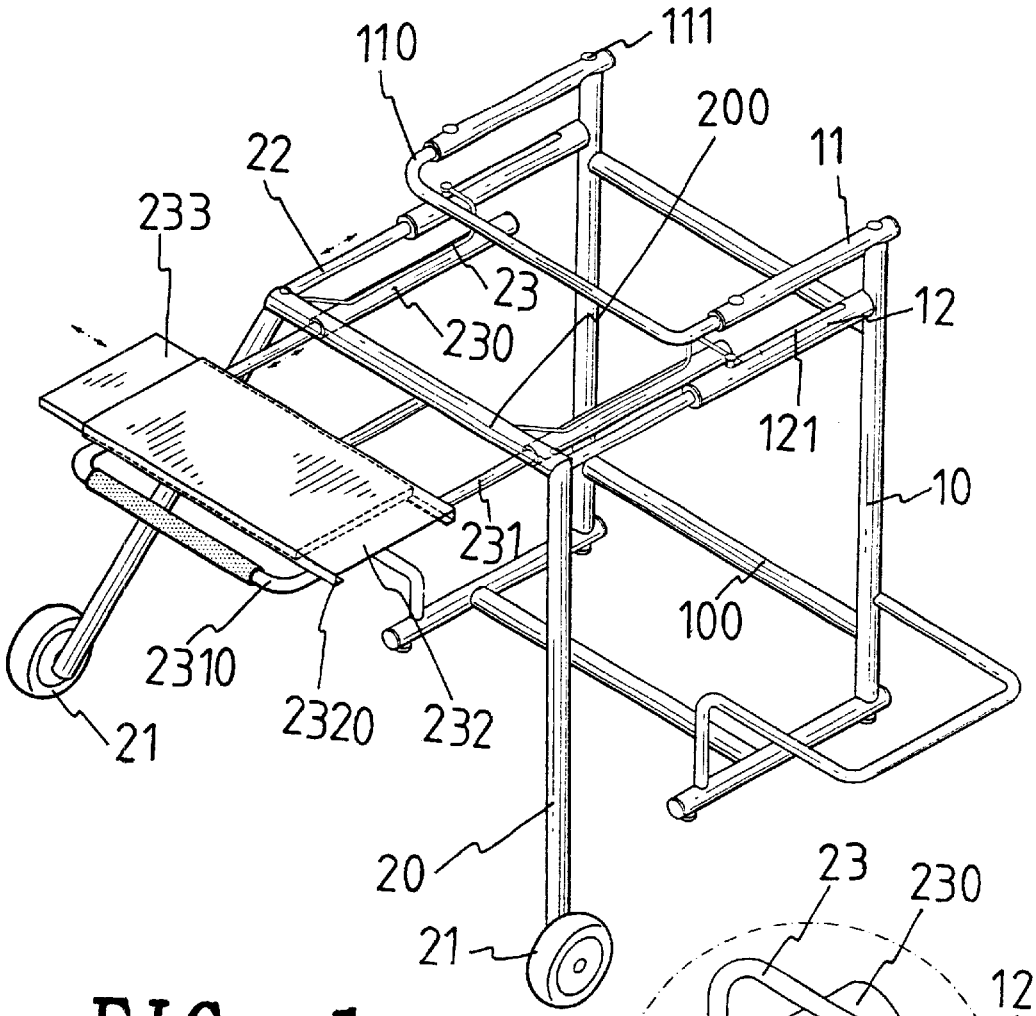
FIG. 1 is a perspective view to show a desk of the present invention.
Figure 2:
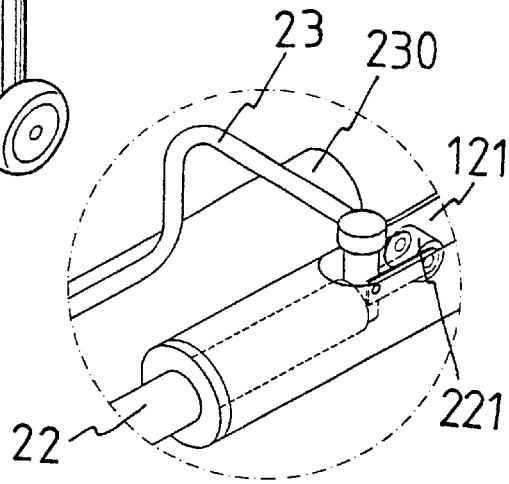
FIG. 2 is a perspective view to show a connection frame extends through the slot in the second support members and is connected to the first rod.
Figure 3:
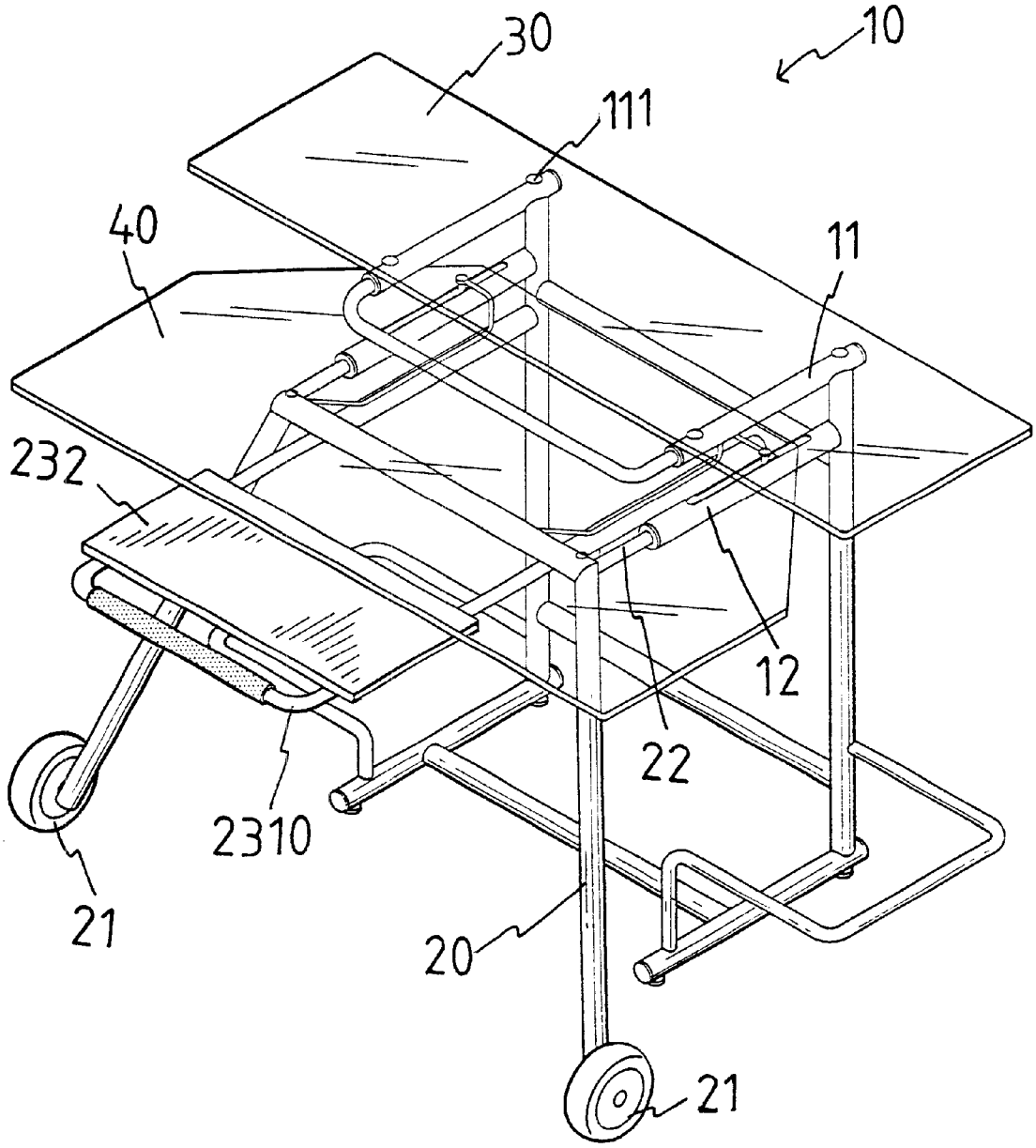
FIG. 3 is a perspective view to show a desk with two tops and a board of the present invention.
Figure 4:
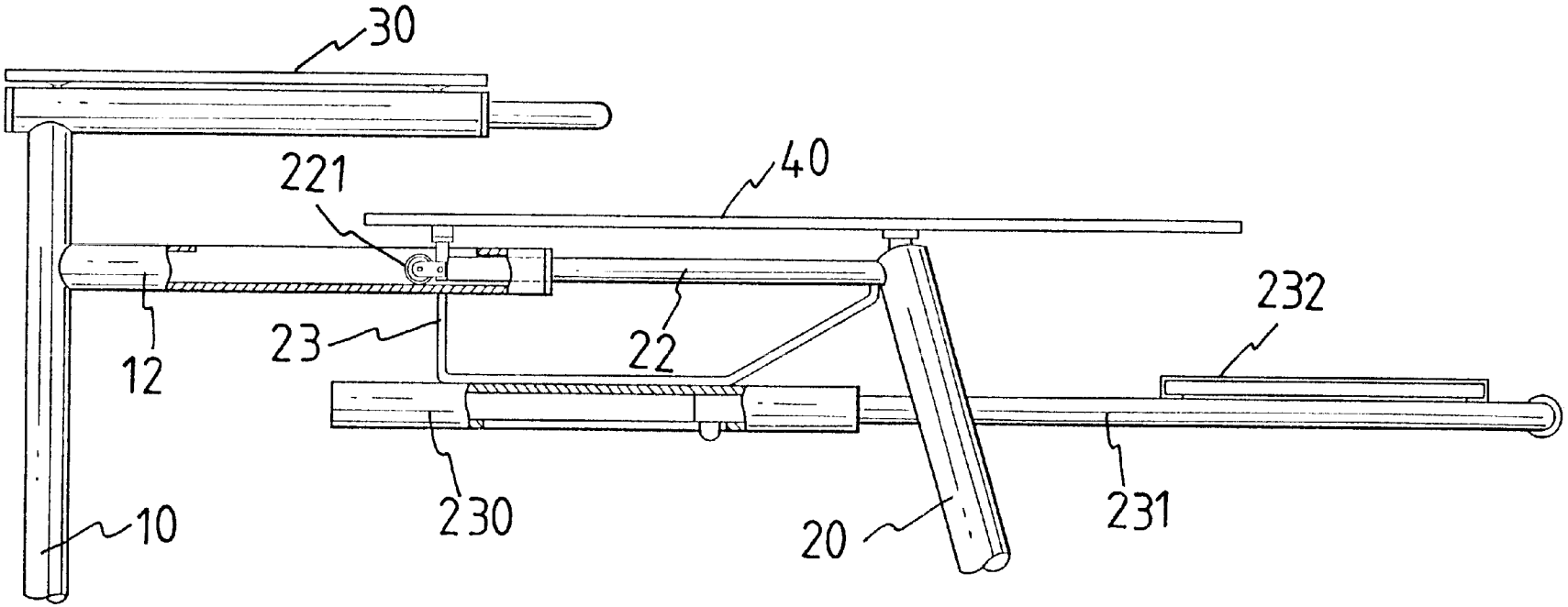
FIG. 4 is a cross sectional view to show the desk of the present invention, wherein the second top and the board are pulled outward.
Figure 5:
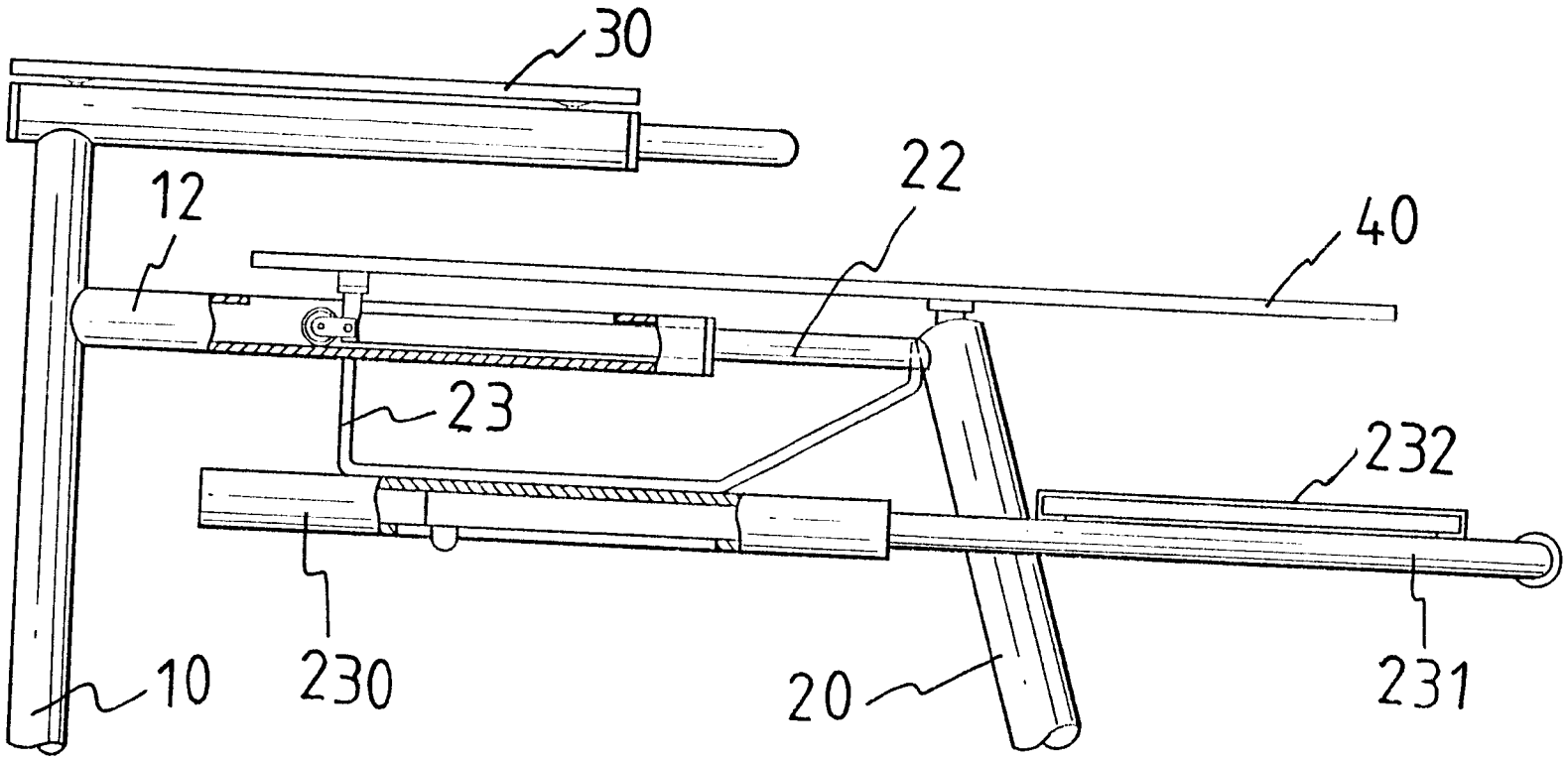
FIG. 5 is a cross sectional view to show the desk of the present invention, wherein the second top and the board are pushed beneath the first top.

Referring to FIGS. 1 to 4, the desk of the present invention comprises two first legs 10 connected by two first transverse bars 100 and two first support members 11 respectively extend from the two first legs 10. A U-shaped transverse tube 110 is connected between the two first support members 11. A first top 30 is supported on the two first support members 11 with pads 111 located between the first top 30 and the two first support members 11. Two second support members 12 respectively extend from the two first legs 10 and are located below the two first support members 11. Each of the second support members 12 has a slot 121 defined therethrough.

Two first rods 22 are retractably received in the two second support members 12 and each of the first rods 22 is connected to a U-shaped connection frame 23. One of two ends of each of the connection frames 23 extends through the slot 121 of the second support members 12 and a second transverse bar 200 is connected between the two first rods 22. Each of the two first rods 22 has a roller 221 connected thereto and received in the second member 12. Two second legs 20 are respectively connected to the second transverse bar 200 and each of the two second legs 20 has a wheel 21 connected thereto so that the two second legs 20 are moved away from the two first legs 10 by pulling the second transverse bar 200. A second top 40 is supported on the two connection frames 23.

Two sleeves 230 are respectively connected to the two connection frames 23 and two second rods 231 are retractably received in the two sleeves 230. A third transverse bar 2310 is connected between the two second rods 231 and a third top 232 is supported on the two second rods 231. Therefore, the third top 232 can be pulled out by pulling the third transverse bar 2310. The third top 232 has two rails 2320 between which a board 233 is slidably connected.

The desk of the present invention effectively use the space and has two more tops which can be received beneath the desk top or pulled out to increase the surface to use.

While we have shown and described various embodiments in accordance with the present invention, it should be clear to those skilled in the art that further embodiments may be made without departing from the scope and spirit of the present invention.

What is claimed is:

1. A desk comprising:

two first legs connected by a first transverse bar and two first support members respectively extending from said two first legs, a first top supported on said two first support members, two second support members respectively extending from said two first legs and located below said two first support members, each of said second support members having a slot defined therethrough;

two first rods retractably received in said two second support members and each of said first rods connected to a connection frame, one of two ends of each of said connection frames extending through said slot of said second support members, a second transverse bar connected between said two first rods and two second legs respectively connected to said second transverse bar, each of said two second legs having a wheel connected thereto, a second top supported on said two connection frames, and two sleeves respectively connected to said two connection frames and two second rods retractably received in said two sleeves, a third top supported on said two second rods.

2. The desk as claimed in claim 1, wherein each of said two first rods has a roller connected thereto and received in said second member.

3. The desk as claimed in claim 1, wherein said third top has two rails between which a board is slidably connected.

4. The desk as claimed in claim 1 further comprising a third transverse bar connected between the two second rods.

* * * * *